US011377340B2

(12) United States Patent
Tasaka et al.

(10) Patent No.: US 11,377,340 B2
(45) Date of Patent: Jul. 5, 2022

(54) FLUID PRESSURE-FEED DEVICE

(71) Applicants: TOYOTA JIDOSHA KABUSHIKI KAISHA, Toyota (JP); PYLES JAPAN CO., LTD., Yokohama Kanagawa-ken (JP)

(72) Inventors: Masahiro Tasaka, Nisshin (JP); Rikiya Makino, Toyota (JP); Takashi Suzuki, Tahara (JP); Takatoshi Urashi, Nisshin (JP); Shouji Suzuki, Yokohama (JP)

(73) Assignees: TOYOTA JIDOSHA KABUSHIKI KAISHA, Toyota (JP); PYLES JAPAN CO., LTD., Yokohama (JP)

( * ) Notice: Subject to any disclaimer, the term of this patent is extended or adjusted under 35 U.S.C. 154(b) by 0 days.

(21) Appl. No.: 16/377,317

(22) Filed: Apr. 8, 2019

(65) Prior Publication Data

US 2019/0314858 A1 Oct. 17, 2019

(30) Foreign Application Priority Data

Apr. 11, 2018 (JP) ..... JP2018-075889

(51) Int. Cl.
*B67D 7/02* (2010.01)
*B05D 7/14* (2006.01)
(Continued)

(52) U.S. Cl.
CPC ..... *B67D 7/0227* (2013.01); *B05B 9/047* (2013.01); *B05C 1/02* (2013.01); *B05D 7/14* (2013.01); *F04B 15/02* (2013.01)

(58) Field of Classification Search
CPC ... B05C 11/1047; B67D 7/645; B67D 7/0227; B05B 9/047
See application file for complete search history.

(56) References Cited

U.S. PATENT DOCUMENTS 2,630,248 A * 3/1953 Hinz ..... B67D 7/0227 222/258
3,055,764 A * 9/1962 Pryor ..... E21B 49/081 166/109
(Continued)

FOREIGN PATENT DOCUMENTS

DE 4340235 A1 6/1995
EP 0564807 A1 * 10/1993 ..... B29B 13/022
(Continued)

OTHER PUBLICATIONS

Partial Translation of Notification of Reason(s) for Refusal dated Oct. 5, 2021 from the Japanese Patent Office in Appl. No. 2018-075889.

*Primary Examiner* — Atif H Chaudry
(74) *Attorney, Agent, or Firm* — Sughrue Mion, PLLC

(57) ABSTRACT

A fluid pressure-feed device includes a main tank and a sub tank. The sub tank is connected integrally with an upper portion of a main follower plate that applies pressurizing force to a urethane adhesive inside the main tank. A drum pump is provided in an upper portion of a sub follower plate provided in the sub tank. While the urethane adhesive is flowing into the sub tank from the main tank, the urethane adhesive is fed under pressure from the sub tank to a fluid passage by actuation of the drum pump. While the main tank is being replaced, the urethane adhesive inside the sub tank is fed under pressure to the fluid passage by the drum pump.

6 Claims, 7 Drawing Sheets

(51) Int. Cl.

| | |
|---|---|
| ***F04B 15/02*** | (2006.01) |
| ***B05B 9/047*** | (2006.01) |
| ***B05C 1/02*** | (2006.01) |

(56) References Cited

U.S. PATENT DOCUMENTS

| | | | | |
|---|---|---|---|---|
| 3,982,669 | A | 9/1976 | Moore | |
| 4,077,750 | A * | 3/1978 | Hake | F04B 9/14 222/309 |
| 4,450,860 | A * | 5/1984 | Francis | F04B 39/108 137/543.19 |
| 4,957,572 | A | 9/1990 | Dewitte et al. | |
| 5,143,255 | A | 9/1992 | Micek | |
| 2005/0207904 | A1 | 9/2005 | Kouno | |
| 2019/0184615 | A1* | 6/2019 | Gerke | B29B 7/728 |

FOREIGN PATENT DOCUMENTS

| | | | | |
|---|---|---|---|---|
| EP | 0564807 | A1 | 10/1993 | |
| JP | 57-148080 | A | 9/1982 | |
| JP | 62-130270 | U | 8/1987 | |
| JP | 2003-286941 | A | 10/2003 | |
| JP | 2006-322359 | A | 11/2006 | |
| JP | 2015-224375 | A | 12/2015 | |
| KR | 10-2013-0127048 | A | 11/2013 | |
| WO | WO-2013118372 | A1 * | 8/2013 | B05C 5/02 |

* cited by examiner

FLUID PRESSURE-FEED DEVICE

INCORPORATION BY REFERENCE

The disclosure of Japanese Patent Application No. 2018-075889 filed on Apr. 11, 2018 including the specification, drawings and abstract is incorporated herein by reference in its entirety.

BACKGROUND

1. Technical Field

The disclosure relates to a fluid pressure-feed device that feeds a fluid such as an adhesive under pressure toward a workpiece in a vehicle body manufacturing line and the like. The disclosure relates to, for example, a measure to reduce a size of the fluid pressure-feed device.

2. Description of Related Art

As disclosed in Japanese Unexamined Patent Application Publication No. 2006-322359 (JP 2006-322359 A), a fluid pressure-feed device is known. The fluid pressure-feed device forces out a fluid such as an adhesive from a tank (a drum) and feeds the fluid under pressure toward a workpiece in order to apply the fluid to the workpiece in a vehicle body manufacturing line.

This kind of fluid pressure-feed device includes a pump unit. FIG. 6 is a partially sectional view of a pump unit a according to a related art. As shown in FIG. 6, the pump unit a includes a follower plate d that applies pressurizing force to a fluid c inside a tank b from above. The follower plate d is supported by an elevator e and able to move upward and downward. Also, a drum pump g connected with a fluid passage (not shown) is attached to the follower plate d. Thus, the follower plate d applies downward pressurizing force to the fluid c inside the tank b, and the fluid c that receives the pressurizing force passes through the follower plate d and is forced out toward the drum pump g. A volume flow rate of the fluid c is adjusted by an actuation of the drum pump g when the fluid c is fed to the fluid route under pressure. The fluid passage is connected with a coating robot (not shown) and the fluid c that reaches the coating robot is applied to the workpiece.

Then, when an amount of the fluid c remaining in the tank b becomes small, it is necessary to replace the tank b. The virtual line in FIG. 6 shows a state where the follower plate d reaches a bottom portion of the tank b as the remaining amount of the fluid c inside the tank b becomes small, and it is thus necessary to replace the tank b.

As a replacement operation of the tank b, it is necessary to remove the follower plate d from an inside of the tank b, remove the fluid c adhered to the follower plate d, carry out the empty tank b, carry in a new tank (a tank filled with the fluid c) b, insert the follower plate d into the new tank b, remove air from the tank b, and so on. It takes a given amount of time (for example, several tens of minutes).

When there is only one pump unit a, pressure-feed of the fluid c cannot be done during replacement of the tank b. Therefore, it is necessary to stop a vehicle body manufacturing line. In view of this, in JP 2006-322359 A, two pump units are provided. Therefore, as shown in FIG. 7, fluid passages f1, f2 extending from first and second pump units a1, a2, respectively, are connected with a route switching valve h, and, while the tank b1 is being replaced in the first pump unit a1, the route switching valve h is switched so that the fluid c2 is fed to a workpiece under pressure from the tank b2 of the second pump unit a2. Thus, it is not necessary to stop the vehicle body manufacturing line during replacement of the tank b1. FIG. 7 shows a state where almost a half of the fluid c1 inside the tank b1 of the first pump unit a1 on the left side is used (fed under pressure toward the coating robot).

SUMMARY

However, with the configuration described in JP 2006-322359 A, since the two pump units a1, a2 are provided side by side, the size of the fluid pressure-feed device becomes large, and it is thus difficult to reduce an installation space for the fluid pressure-feed device.

The disclosure provides a fluid pressure-feed device that is able to become compact and also feed a fluid under pressure continuously to a fluid passage.

The disclosure relates to a fluid pressure-feed device that feeds a fluid under pressure to a fluid passage. The fluid pressure-feed device includes a main tank configured to be filled with the fluid, a main follower plate, a sub tank, and a pump. The main follower plate applies pressurizing force toward the fluid inside the main tank. The sub tank is provided integrally with the main follower plate, and the fluid forced out from the main tank flows into the sub tank. The pump feeds the fluid inside the sub tank under pressure toward the fluid passage.

With the configuration, in a state where a sufficient amount of the fluid remains in the main tank, the fluid extruded from the main tank flows into the sub tank. The fluid inside the sub tank is then fed under pressure by the pump toward the fluid passage. Once the amount of the fluid remaining in the main tank becomes small, and the main tank needs to be replaced, it is possible to feed the fluid inside the sub tank under pressure toward the fluid passage during the replacement operation of the main tank. This means that the fluid inside the sub tank is fed under pressure by the pump toward the fluid passage. During the replacement operation, since the fluid does not flow into (is not supplied in) the sub tank, an amount of the fluid remaining in the sub tank is reduced gradually. However, when the replacement operation of the main tank is completed before the fluid inside the sub tank is gone, the fluid is forced out from the main tank again, and flows into the sub tank, and the fluid is supplied in the sub tank. Therefore, it is possible to continuously feed the fluid under pressure toward the fluid passage. It is only necessary to ensure that a capacity of the sub tank is an amount of the fluid required during replacement of the main tank (a required amount of the fluid to be fed under pressure to the fluid passage). Therefore, with the solution, it is not necessary to provide a plurality of pump units having the same configuration side by side (each unit being made of a tank and a follower plate), and it is thus possible to reduce a size of the fluid pressure-feed device.

Further, the fluid pressure-feed device may include a sub follower plate that is configured to apply pressurizing force to the fluid inside the sub tank, the pressurizing force being used to force out the fluid toward the pump during the replacement operation of the main tank.

With the configuration, due to the pressurizing force applied to the fluid inside the sub tank, the fluid flows from the sub tank toward the pump in a favorable manner during the replacement operation of the main tank, and a pressure-feed operation of the fluid by the pump is thus carried out in a favorable manner. Hence, it is possible to optimize an amount of the fluid to be fed under pressure to the fluid passage.

Further, the fluid pressure-feed device may further include a check valve that is disposed between the main follower plate and the sub tank, and configured so as to open when pressure of the fluid inside the main tank becomes a given value or higher.

With the configuration, the check valve opens only when pressure of the fluid inside the main tank reaches the given value or higher, and the fluid flows from the main tank to the sub tank. This means that no backflow of the fluid from the sub tank to the main tank happens. Therefore, a situation is prevented where an amount of the fluid remaining in the sub tank is insufficient at a point when the main tank needs to be replaced. As a result, it is possible to avoid a situation where an amount of the fluid inside the sub tank is insufficient during the replacement operation of the main tank, and it is thus possible to continuously feed the fluid under pressure toward the fluid passage.

Further, a capacity of the sub tank may be set so as to be smaller than a capacity of the main tank and also larger than a required amount of the fluid by a given value. The required amount of the fluid is an amount of the fluid to be fed under pressure toward the fluid passage during the replacement operation of the main tank.

With the configuration, it is possible to reduce the size of the sub tank to an almost minimum, and this contributes to a size reduction of the fluid pressure-feed device.

In the disclosure, the main follower plate and the sub tank are provided. The main follower plate applies pressurizing force to the fluid inside the main tank. The sub tank is provided integrally with the main follower plate, and the fluid forced out from the main tank flows into the sub tank. Thus, the fluid is fed under pressure toward the fluid passage from the sub tank. Thus, it is possible to feed the fluid inside the sub tank under pressure to the fluid passage during the replacement operation of the main tank, and it is not necessary to provide a plurality of pump units having the same configuration. As a result, it is possible to reduce the size of the fluid pressure-feed device while enabling the fluid to be continuously fed under pressure to the fluid passage.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

An embodiment of the disclosure is described below based on the drawings. In the embodiment, the disclosure is applied to a fluid pressure-feed device in a vehicle body manufacturing line. The fluid pressure-feed device feeds a urethane adhesive under pressure to a coating robot. The urethane adhesive is to be applied to a window glass that is a workpiece (an adhesive for adhering the window glass to a vehicle body; a fluid).

Configuration of Fluid Pressure-Feed Device

Figure 1:
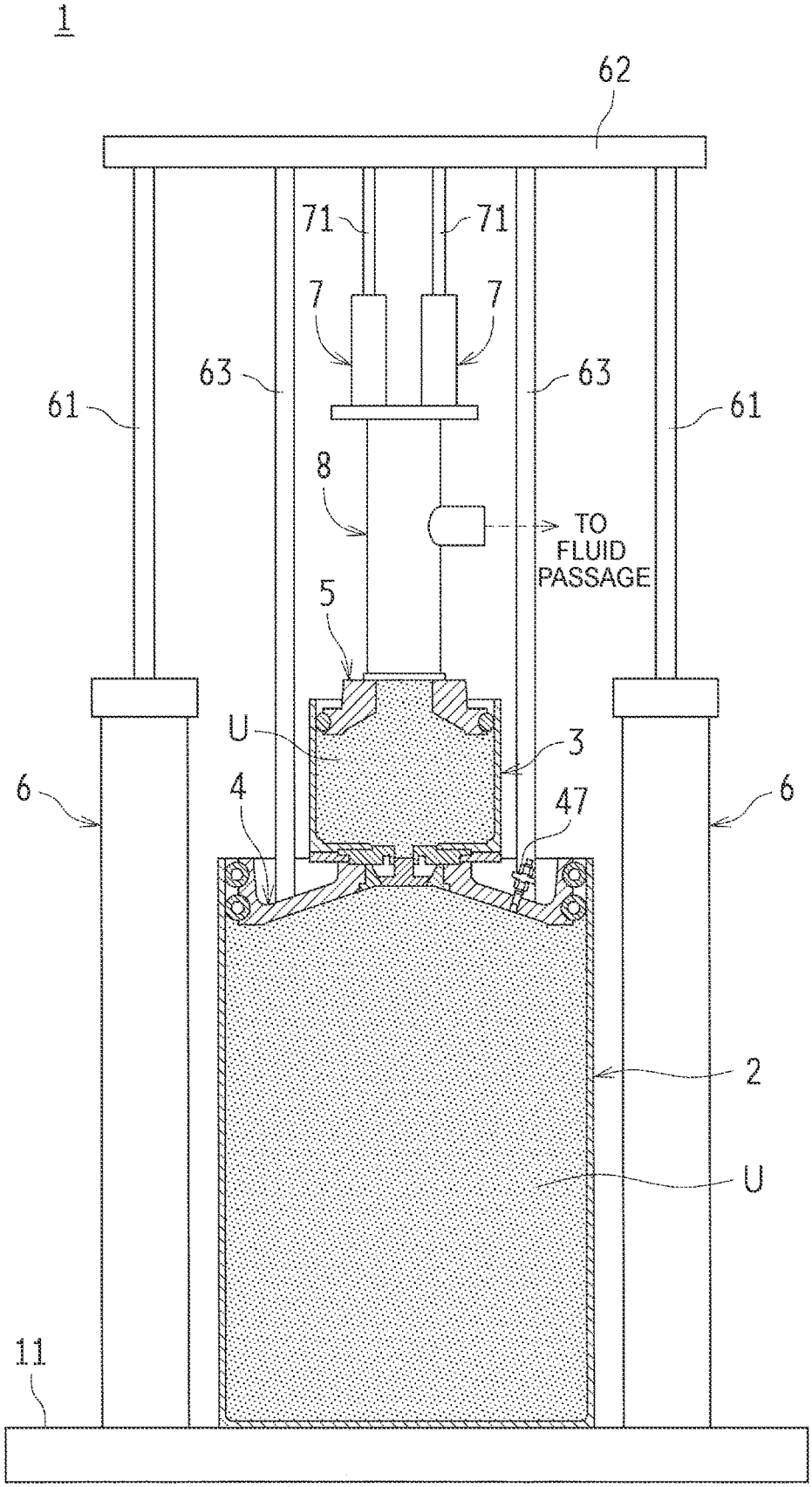
FIG. 1 is a sectional view of a part of a fluid pressure-feed device according to an embodiment.

FIG. 1 is a sectional view of a part of a fluid pressure-feed device 1 according to the embodiment. As shown in the drawing, the fluid pressure-feed device 1 includes a main tank 2, a sub tank 3, a main follower plate 4, a sub follower plate 5, a pair of main cylinders 6, sub cylinders 7, a drum pump (pump) 8, and so on.

A pressure-feed operation of the urethane adhesive U in the fluid pressure-feed device 1 is roughly described as follows. As shown in FIG. 1, in a state where the main tank 2 and the sub tank 3 are both filled with the urethane adhesive U, the urethane adhesive U is forced out from the main tank 2 toward the sub tank 3. While the urethane adhesive U being forced out, a given amount of the urethane adhesive U (an amount required by a coating robot (not shown)) is fed under pressure by the drum pump 8 from the sub tank 3 toward the coating robot through a fluid passage.

Hereinafter, each component of the fluid pressure-feed device 1 is described.

The main tank 2 is a drum filled with the urethane adhesive U and is replaced when an amount of the urethane adhesive U remaining inside the main tank 2 is becomes small. In the fluid pressure-feed device 1, the main cylinders 6 are erected on a base plate 11, and the main tank 2 is disposed between the main cylinders 6. The main cylinders 6 are made of air cylinders, respectively, and their piston rods 61 extend on top of the main cylinders 6, respectively. Upper ends of the piston rods 61 are attached to a tie bar 62 extending along a horizontal direction. An upper portion of the main tank 2 is open, and the open portion is closed by the main follower plate 4. An upper surface of the main follower plate 4 and the tie bar 62 are connected with each other by tie rods 63.

With the configuration, when the tie bar 62 moves upward and downward due to actuation of the main cylinders 6, then the main follower plate 4 connected with the tie bar 62 through the tie rods 63 also moves upward and downward accordingly. As the main cylinders 6 are actuated, the main follower plate 4 applies pressurizing force to the urethane adhesive U inside the main tank 2 from above. Due to the pressurizing force, the urethane adhesive U inside the main tank 2 passes a check valve (details are provided later) provided in the main follower plate 4, and is then forced out to the sub tank 3. As the urethane adhesive U is forced out from an inside of the main tank 2, an amount of the urethane adhesive U remaining in the main tank 2 becomes smaller. Accordingly, the main follower plate 4 moves downward inside the main tank 2.

In a state where the tie bar 62 is at the most elevated position within a range where the tie bar 62 is able to move upward and downward along with actuation of the main cylinders 6, the main follower plate 4 is positioned above the upper end of the main tank 2 by a given dimension. Because the main follower plate 4 retreats from the upper end of the main tank 2, it is possible to replace the main tank 2 (to carry in and out the main tank 2). Further, in a state where the tie bar 62 is at the most lowered position, the main follower plate 4 is positioned so as to reach a bottom portion of the main tank 2 (see the state shown in FIG. 4). Thus, an amount of the urethane adhesive U remaining inside the main tank 2 at the time of replacement of the main tank 2 can be reduced as much as possible.

Figure 2:
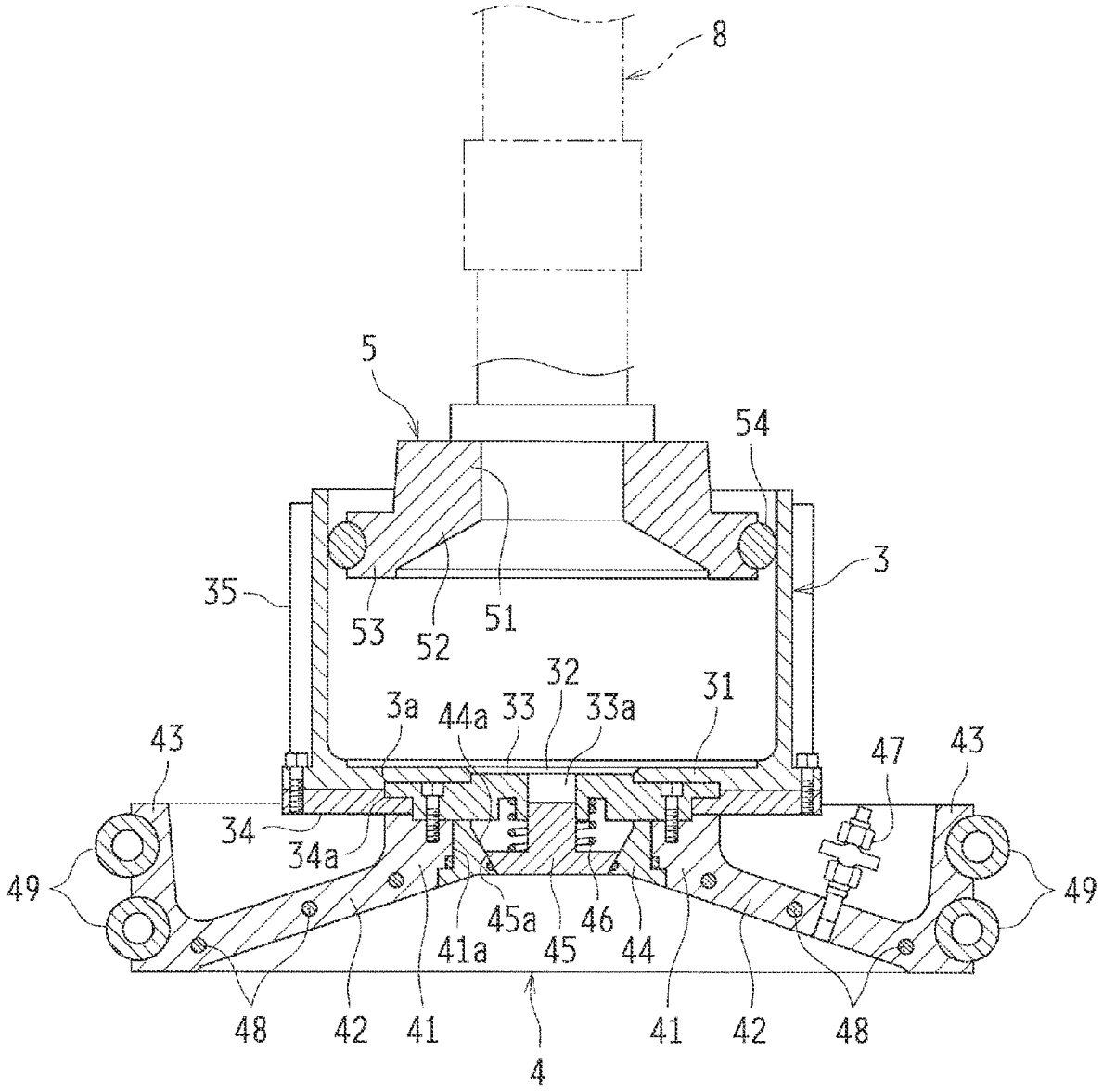
FIG. 2 is a sectional view of a connecting portion between a sub tank and a main follower plate.

The sub tank 3 is connected integrally with an upper portion of the main follower plate 4. FIG. 2 is a sectional view of a connecting portion between the sub tank 3 and the main follower plate 4. As shown in the drawing, an upper portion of the sub tank 3 is open, and the open portion is closed by the sub follower plate 5. An adhesive introduction port 32 is formed in a center portion of a bottom plate 31 of the sub tank 3.

A joint plate 33 and a mounting bracket 34 are interposed between the sub tank 3 and the main follower plate 4. In a center portion of the joint plate 33, an opening 33*a* communicating with the adhesive introduction port 32 is formed. The joint plate 33 is layered on the upper surface of the main follower plate 4 and fastened to the main follower plate 4 by bolts. The mounting bracket 34 is layered on a lower surface of the sub tank 3 and fastened to an outer edge portion of the sub tank 3 by bolts. Further, step portions 3*a*, 34*a* are formed in the lower surface of the sub tank 3 and an upper surface of the mounting bracket 34, respectively, so as to form a space where an outer edge portion of the joint plate 33 is inserted. The outer edge portion of the joint plate 33 is inserted into the space formed between the step portions 3*a*, 34*a*, and the outer edge portion of the joint plate 33 is sandwiched between the lower surface of the sub tank 3 and the upper surface of the mounting bracket 34. Thus, the sub tank 3 and the main follower plate 4 are connected integrally with each other. An outer periphery of the sub tank 3 is covered by a heater cover 35 in order to restrain the urethane adhesive U from hardening.

A capacity of the sub tank 3 is set to be larger than an amount of the urethane adhesive U required during replacement of the main tank 2 (a required amount of a fluid to be fed to the fluid passage under pressure) by a given amount (an amount that is added based on a previously-set safety factor). The amount of the urethane adhesive U required during replacement of the main tank 2 is set based on experiments and empirical rules.

As described earlier, the main follower plate 4 closes the open portion of the upper portion of the main tank 2. In this state, the main follower plate 4 applies pressurizing force to the urethane adhesive U inside the main tank 2 from above. The pressurizing force acts as force for forcing out the urethane adhesive U inside the main tank 2 toward the sub tank 3.

As shown in FIG. 2, the main follower plate 4 is made of a cylindrical center portion 41, an inclined plate portion 42, and an outer edge portion 43 that are formed integrally. The joint plate 33 is fastened to the cylindrical center portion 41 by bolts. The inclined plate portion 42 is inclined obliquely downward and to an outer side from an outer periphery of the center portion 41. The outer edge portion 43 extends upward from an outer peripheral edge of the inclined plate portion 42 by a given dimension.

A check plate 45 is attached through a check plate receiver 44 to an opening 41*a* that is formed in the center portion 41. The check plate receiver 44 and the check plate 45 have inclined surfaces 44*a*, 45*a*, respectively, that are inclined obliquely downward to an inner side, and the inclined surfaces 44*a*, 45*a* are in contact with each other. Further, a coil spring 46 applies downward biasing force to the check plate 45. This configuration is regarded as a check valve according to the disclosure. Therefore, when upward pressing force (pressing force caused by the pressurizing force) acting on the check plate 45 from the urethane adhesive U is smaller than a given value, the check plate 45 is at a closed position due to the biasing force of the coil spring 46 (the state shown in FIG. 2). Meanwhile, when pressing force acting on the check plate 45 from the urethane adhesive U is equal to or larger than the given value, the check plate 45 moves upward against the biasing force of the coil spring 46, and the inclined surface 45*a* of the check plate 45 retreats from the inclined surface 44*a* of the check plate receiver 44. Thus, a fluid passage is formed between the inclined surfaces 45*a*, 44*a*. Therefore, a part of the urethane adhesive U inside the main tank 2 flows into the sub tank 3 through the fluid passage, the opening 33*a* of the joint plate 33, and the adhesive introduction port 32 of the sub tank 3.

Also, an air vent plug 47 is attached to the inclined plate portion 42 of the main follower plate 4. The air vent plug 47 is switched to close and open by, for example, a manual operation. When the air vent plug 47 is in the open state, a space below and a space above the main follower plate 4 communicate with each other. Therefore, when the air vent plug 47 is open in a state where the main follower plate 4 is inserted into the main tank 2, an internal space of the main tank 2 communicates with the atmosphere. When the air vent plug 47 is in the closed state, the space below and the space above the main follower plate 4 are separated from each other. Therefore, when the air vent plug 47 is closed in a state where the main follower plate 4 is inserted in the main tank 2, the internal space of the main tank 2 is separated from the atmosphere.

Further, electric heaters 48 are buried in the inclined plate portion 42 of the main follower plate 4 in order to restrain the urethane adhesive U from hardening. Furthermore, two seal hoses 49 are attached to an outer peripheral surface of the outer edge portion 43 of the main follower plate 4 in a circumferential direction of the main follower plate 4. The seal hoses 49 are provided to ensure that the outer peripheral edge of the main follower plate 4 and an inner surface of the main tank 2 are sealed to each other.

As described earlier, the sub follower plate 5 closes the open portion of the upper portion of the sub tank 3. In this state, as the sub cylinders 7 described later are actuated, the sub follower plate 5 are able to apply pressurizing force to the urethane adhesive U inside the sub tank 3 from above. The pressurizing force works as force for forcing out the urethane adhesive U inside the sub tank 3 toward the drum pump 8. The pressurizing force is set to a value that does not allow a later-described check valve 83 of the drum pump 8 to open.

As shown in FIG. 2, the sub follower plate 5 is made of a cylindrical center portion 51, an inclined plate portion 52, and an outer edge portion 53 that are formed integrally. The drum pump 8 is connected with the center portion 51 by means such as bolt fastening. The inclined plate portion 52 is inclined obliquely downward to the outer side from an outer periphery of the center portion 51. The outer edge portion 53 extends to the outer side in the horizontal direction from an outer peripheral edge of the inclined plate portion 52 by a given dimension.

A seal hose 54 is attached to an outer peripheral surface of the outer edge portion 53 of the sub follower plate 5 in a circumferential direction of the sub follower plate 5. The seal hose is provided to ensure that an outer peripheral edge of the sub follower plate 5 and an inner surface of the sub tank 3 are sealed to each other.

The drum pump 8 draws out the urethane adhesive U filled in the sub tank 3 and feeds a given amount of the urethane adhesive U under pressure toward the coating robot through the fluid passage.

Figure 3:
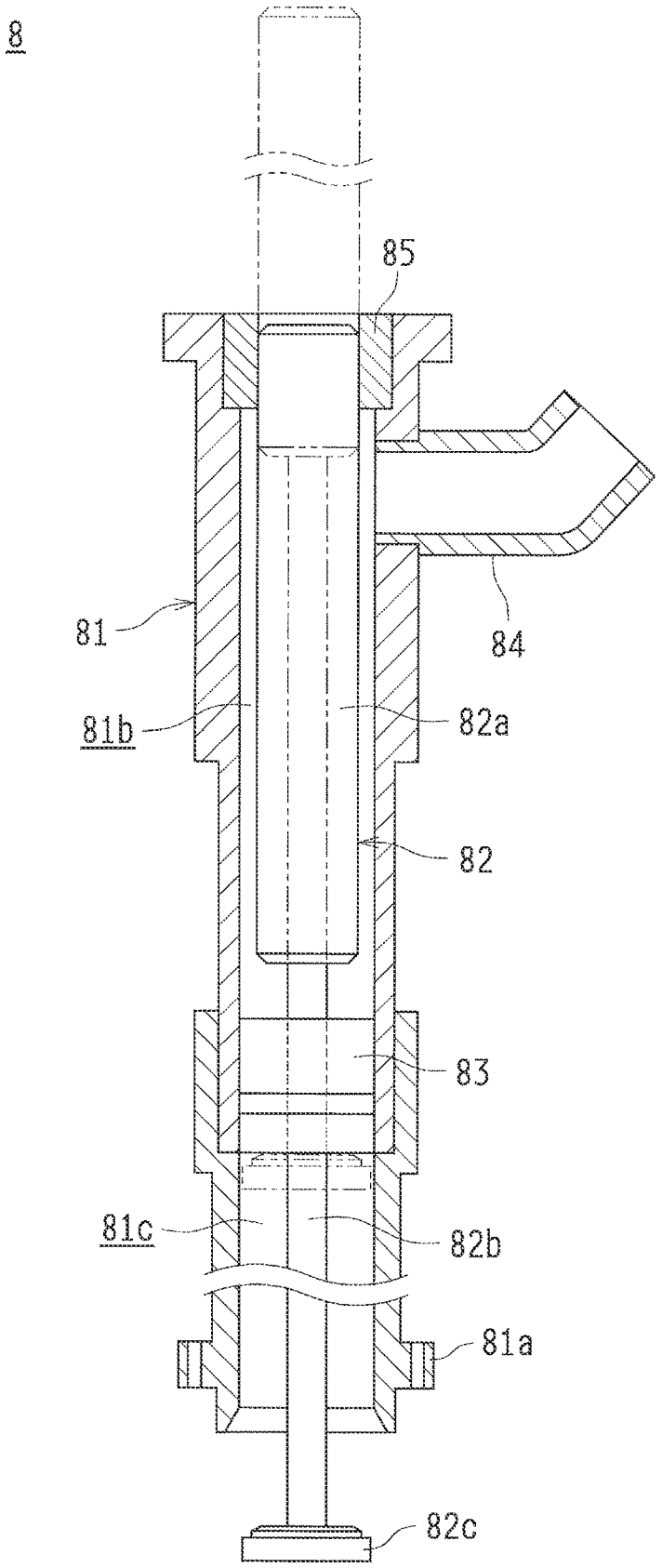
FIG. 3 is a sectional view of a drum pump.

FIG. 3 is a sectional view of the drum pump 8. As shown in FIG. 3, the drum pump 8 is configured so that a pump rod 82 is inserted and reciprocates in a pump casing 81.

A flange 81*a* is provided in a lower portion of the pump casing 81 in order to attach the drum pump 8 to the sub follower plate 5, and the flange 81*a* is fastened to the sub follower plate 5 by bolts. Thus, an inside of the pump casing 81 and an inside of the sub tank 3 communicate with each other through the sub follower plate 5 (through an opening of the center portion 51 of the sub follower plate 5).

Further, the check valve 83 is provided inside the pump casing 81, and the check valve 83 divides the inside of the pump casing 81 into an upper space 81*b* and a lower space 81*c*. The check valve 83 opens and closes depending on a pressure difference between the upper space 81*b* and the lower space 81*c*. Specifically, when pressure in the lower space 81*c* becomes higher than pressure in the upper space 81*b* by a given value, the check valve 83 opens, and the urethane adhesive U is allowed to flow into the upper space 81*b* from the lower space 81*c*. Meanwhile, even when pressure in the upper space 81*b* is higher than pressure in the lower space 81*c*, or pressure in the lower space 81*c* is higher than pressure in the upper space 81*b*, the check valve 83 is closed when the difference is smaller than the given value, and the urethane adhesive U does not flow between the upper space 81*b* and the lower space 81*c*. An adhesive lead out pipe 84 is connected with the pump casing 81. The adhesive lead out pipe 84 communicates with the upper space 81*b*. Also, a packing seal nut 85 that seals the pump casing 81 and the pump rod 82 to each other is attached to the upper portion of the pump casing 81.

The pump rod 82 includes a large-diameter portion 82*a* and a small-diameter portion 82*b*. The large-diameter portion 82*a* is positioned in the upper space 81*b* and has a diameter slightly smaller than an inner diameter dimension of the upper space 81*b*. The small-diameter portion 82*b* is inserted into the check valve 83 and has an outer diameter dimension that is set to be smaller than that of the large-diameter portion 82*a*. Further, the pump rod 82 is able to move upward and downward (move vertically) inside the pump casing 81 due to an actuation of an air motor (not shown). Further, a primer disc 82*c* is attached to a lower end portion of the small-diameter portion 82*b*. An outer diameter dimension of the primer disc 82*c* is almost the same as an inner diameter dimension of the lower space 81*c* of the pump casing 81. Therefore, in a state where the pump rod 82 moves upward and the primer disc 82*c* is positioned in the lower space 81*c*, a lower side of the lower space 81*c* is closed.

Since the drum pump 8 is configured as described above, in the state where the pump rod 82 moves upward and the primer disc 82*c* is positioned inside the lower space 81*c*, when the pump rod 82 further moves upward and a space between the primer disc 82*c* and the check valve 83 becomes smaller, pressure in the space increases. Once a difference between this pressure and pressure in the upper space 81*b* reaches a given value, the check valve 83 opens, and the urethane adhesive U flows into the upper space 81*b*.

As shown by a virtual line in FIG. 3, when the pump rod 82 moves upward until the primer disc 82*c* reaches the vicinity of the check valve 83, a most part of the large-diameter portion 82*a* of the pump rod 82 is pulled out upward from the pump casing 81, and the small-diameter portion 82*b* is present in a most part of the upper space 81*b* of the pump casing 81. In this state, a gap between an inner peripheral surface of the pump casing 81 and an outer peripheral surface of the small-diameter portion 82*b* in the upper space 81*b* becomes relatively large. Therefore, a relatively large amount of the urethane adhesive U is present in (flows into) the upper space 81*b*.

When the pump rod 82 moves downwardly from this state, the large-diameter portion 82*a* of the pump rod 82 enters the upper space 81*b* of the pump casing 81. Thus, the urethane adhesive U is forced out toward the adhesive lead out pipe 84 by an amount based on a difference between a mass of the small-diameter portion 82*b* that moves from the upper space 81*b* to the lower space 81*c*, and a mass of the large-diameter portion 82*a* that enters the upper space 81*b*. Thus, by adjusting a downward movement of the pump rod 82, an amount of the urethane adhesive U forced out from the pump casing 81 is adjusted. Also, it is possible to adjust an amount of the urethane adhesive U that is fed under pressure toward the coating robot through the fluid passage. The amount of the urethane adhesive U to be fed under pressure is adjusted as a controller (not shown) receives information regarding an amount of the urethane adhesive U required by the coating robot, and the controller actuates the air motor to adjust a downward movement of the pump rod 82.

Further, as shown in FIG. 1, the sub cylinders 7 are attached to the upper portion of the drum pump 8. The sub cylinders 7 are made of air cylinders, and their piston rods 71 extend on top of the sub cylinders 7, respectively. Upper ends of the piston rods 71 are attached to the tie bar 62. Therefore, when the tie bar 62 moves upward and downward due to actuation of the main cylinders 6, not only the main follower plate 4 but also the sub tank 3, the sub follower plate 5, and the drum pump 8 move upward and downward. When the sub cylinders 7 are actuated, the drum pump 8 and the sub follower plate 5 move upward and downward with respect to the sub tank 3. When the sub follower plate 5 moves downward, the sub follower plate 5 applies pressurizing force to the urethane adhesive U inside the sub tank 3 from above, and the urethane adhesive U inside the sub tank 3 is forced out to the drum pump 8 due to the pressurizing force. Further, the fluid passage is made of a flexible pipe so that the urethane adhesive U is fed under pressure in a favorable manner even when the drum pump 8 moves upward and downward.

Operations of Fluid Pressure-Feed Device

Next, operations of the fluid pressure-feed device 1 configured as described above are described. FIG. 1 shows a state where the main tank 2 and the sub tank 3 are both filled with the urethane adhesive U. When pressure feed of the urethane adhesive U starts from this state, the tie bar 62 moves downward due to actuation of the main cylinders 6, and, due to this, the main follower plate 4 applies pressurizing force to the urethane adhesive U inside the main tank 2 from above. When pressing force acting on the check plate 45 (see FIG. 2) from the urethane adhesive U inside the main tank 2 due to the pressurizing force becomes a given value or larger, the check plate 45 moves upward, and a part of the urethane adhesive U inside the main tank 2 flows into the sub tank 3 through the opening 33*a* of the joint plate 33 and the adhesive introduction port 32 of the sub tank 3.

Meanwhile, in the state where the pump rod 82 of the drum pump 8 moves upward and the primer disc 82*c* is positioned inside the lower space 81*c*, when the pump rod 82 moves further upward and the space between the primer disc 82*c* and the check valve 83 becomes small, pressure in the space increases. Once a difference between the pressure and pressure in the upper space 81*b* reaches a given value, the check valve 83 opens and the urethane adhesive U flows into the upper space 81*b*. Then, when the pump rod 82 moves downward, a given amount of the urethane adhesive U is forced out from the pump casing 81 to the adhesive lead out pipe 84 in accordance with an amount of the downward movement, and the urethane adhesive U is fed under pressure toward the coating robot through the fluid passage. The urethane adhesive U is applied to the window glass by the coating robot. A downward movement of the pump rod 82 (a forcing-out operation of the urethane adhesive U from the pump casing 81 to the adhesive lead out pipe 84) is carried out intermittently every time an application operation of the urethane adhesive U to the window glass is carried out.

As the flowing operation of the urethane adhesive U into the sub tank 3 from the main tank 2, and the pressure-feed operation of the urethane adhesive U to the fluid passage by the drum pump 8 continue, the urethane adhesive U in the main tank 2 is consumed. Accordingly, an amount of the urethane adhesive U remaining in the main tank 2 is reduced, and the main follower plate 4 moves downward inside the main tank 2.

Figure 4:
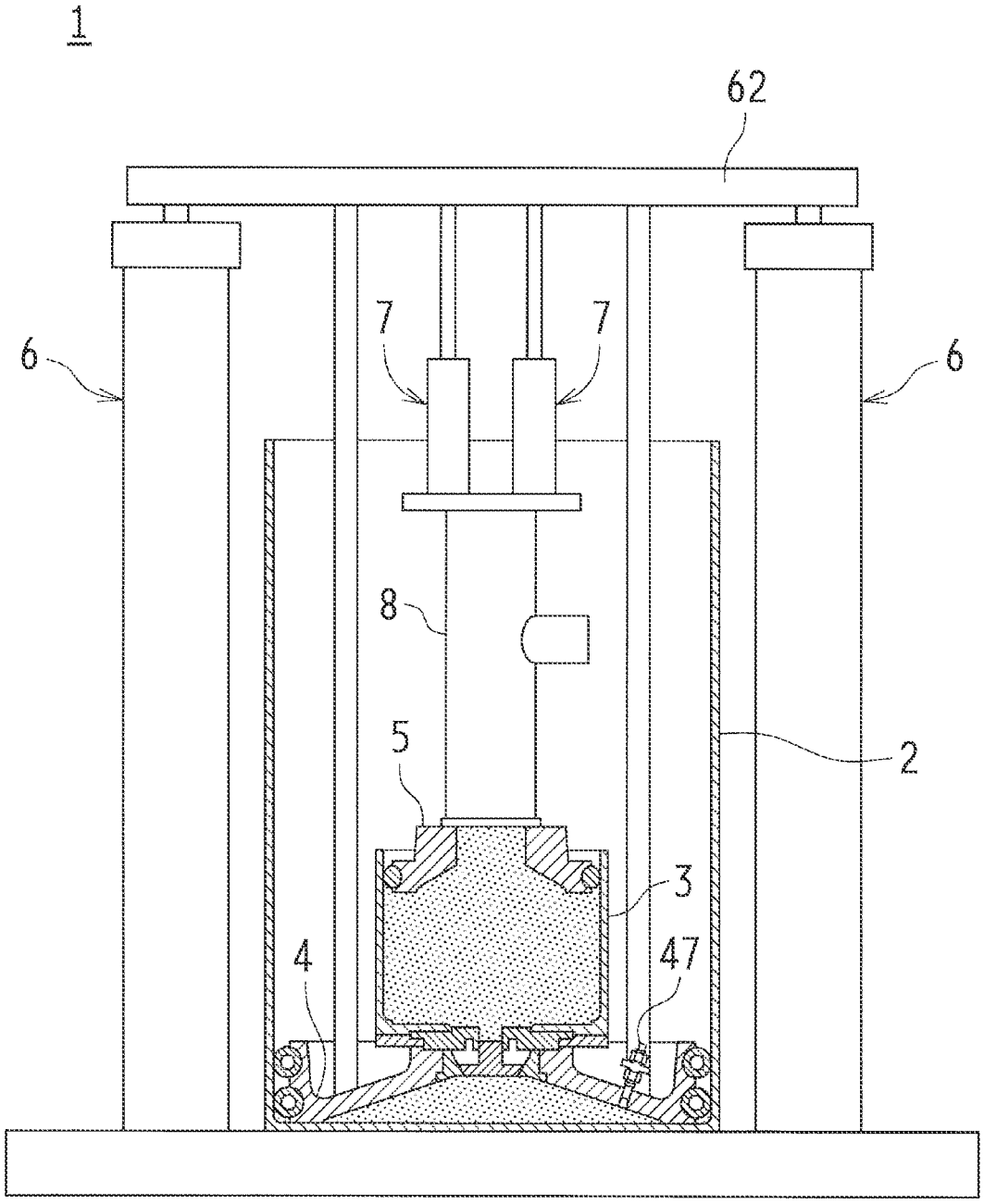
FIG. 4 is a view equivalent to FIG. 1 and shows a state where an amount of a urethane adhesive remaining in the main tank is small.

Then, as shown in FIG. 4, when the main follower plate 4 reaches the bottom portion the main tank 2, it is necessary to replace the main tank 2. An elevated position of the tie bar 62 is sensed by a sensor (not shown), and, when the elevated position of the tie bar 62 reaches a given position (a position where the main follower plate 4 reaches the bottom portion of the main tank 2), information for encouraging replacement the main tank 2 is sent to an operator. For example, a lamp provided in an operation panel (not shown) is turned on, or sound is transmitted.

Operations during Replacement of Main Tank

When the main tank 2 is replaced, the urethane adhesive U inside the sub tank 3 is fed under pressure to the fluid passage. This means that, while a later-described replacement operation of the main tank is carried out, the urethane adhesive U is still allowed to flow from the sub tank 3 due to actuation of the drum pump 8, and the urethane adhesive U is fed toward the fluid passage under pressure. Therefore, the actuation of the drum pump 8 is carried out similarly to the foregoing operation. Specifically, whether or not the main tank 2 is present, the actuation of the drum pump 8 is carried out in accordance with an amount of the urethane adhesive U required by the coating robot.

When the main tank 2 is replaced, upward pressing force does not act on the check plate 45. Therefore, the check plate 45 is in contact with the check plate receiver 44, and the urethane adhesive U does not leak from the sub tank 3.

Figure 5:
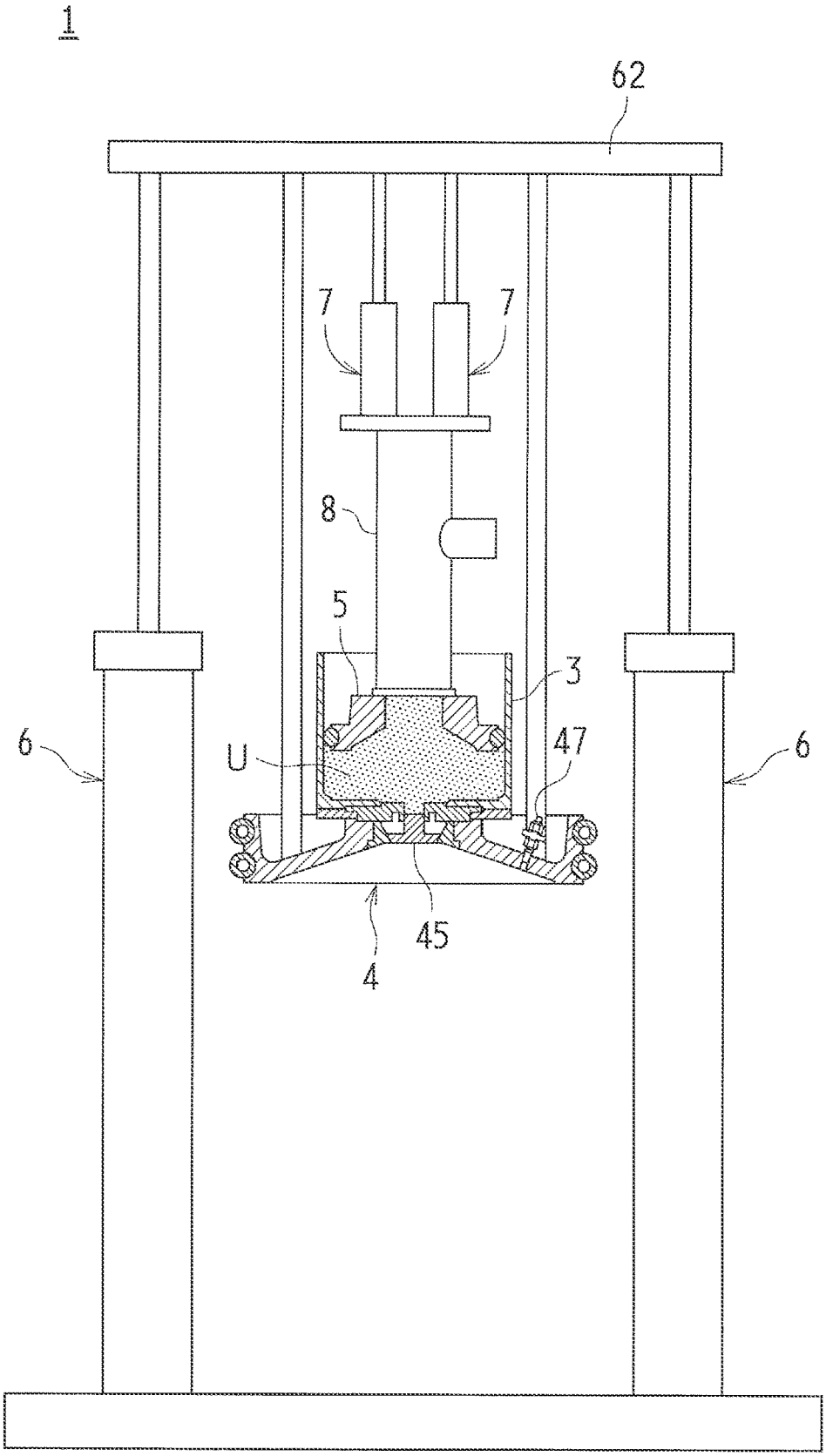
FIG. 5 is a view equivalent to FIG. 1 and shows a state where the main tank is being replaced.
Figure 6:
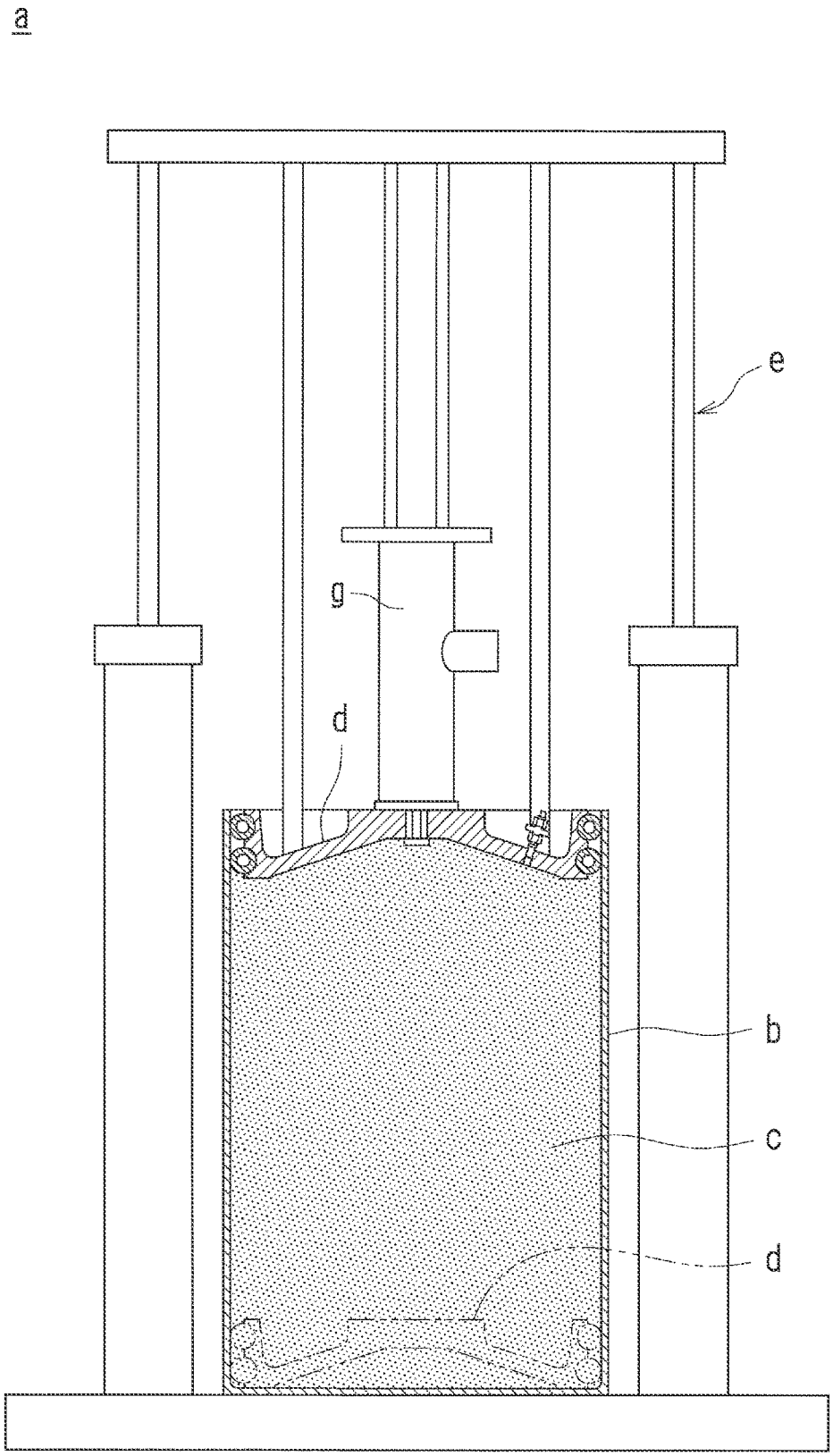
FIG. 6 RELATED ART
FIG. 6 is a view according to a related art and is equivalent to FIG. 1.
Figure 7:
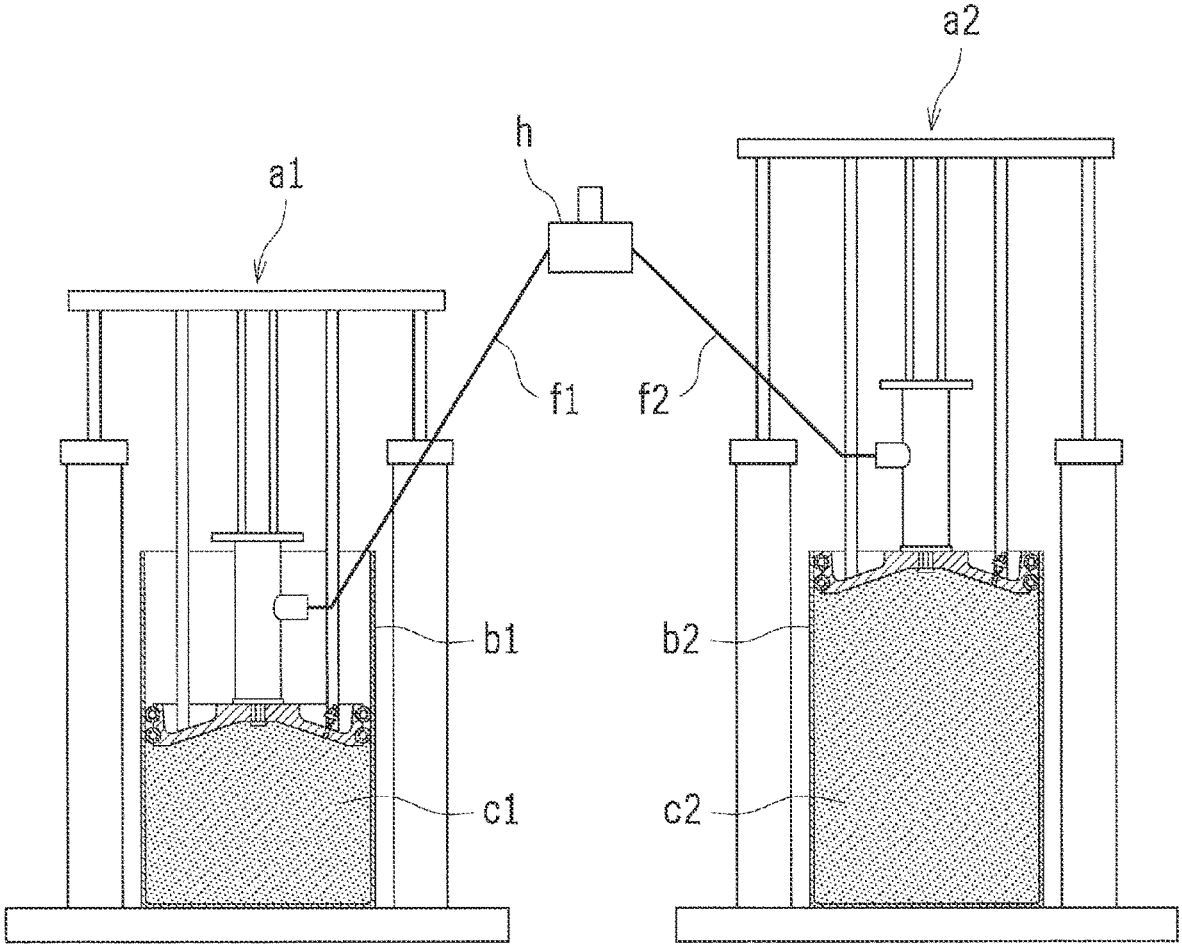
FIG. 7 RELATED ART
FIG. 7 is a view of a fluid pressure-feed device according to a related art in which two pump units are provided.

As the replacement operation of the main tank 2, first of all, the main follower plate 4 that reaches the bottom portion of the main tank 2 is removed from the main tank 2. In this operation, the air vent plug 47 is in the open state, and an internal space of the main tank 2 is communicated with the atmosphere. In this state, the main cylinders 6 are actuated and the main follower plate 4 is pulled up. At this time, air enters the main tank 2 from the air vent plug 47, and the main follower plate 4 is thus pulled up easily. The main follower plate 4 is positioned above the upper end of the main tank 2 by a given dimension, and retreated from the upper end of the main tank 2. Then, the urethane adhesive U adhered to the main follower plate 4 is removed, and, at the same time, the empty main tank 2 is carried out. FIG. 5 shows a state where the main tank 2 is carried out as described above.

Thereafter, a new main tank (a tank filled with the urethane adhesive U) 2 is carried in. This means that the new main tank 2 is placed on top of the base plate 11. Thereafter, the main cylinders 6 are actuated so that the main follower plate 4 is lowered and inserted into the main tank 2. At a point when the main follower plate 4 is inserted into the main tank 2, there is air between the main follower plate 4 and the urethane adhesive U. Therefore, an operation of removing the air (an air removing operation) is carried out. In the air removing operation, the main follower plate 4 is lowered and the air is discharged from the air vent plug 47 to an outside. When all of the air is discharged and the urethane adhesive U flows out from the air vent plug 47, the air vent plug 47 is brought into a closed state.

During the replacement operation of the main tank 2 described above, the urethane adhesive U does not flow (is not supplied) into the sub tank 3. This means that the pressure-feed operation of the urethane adhesive U to the fluid passage from the sub tank 3 continues while no urethane adhesive U flows into the sub tank 3. Therefore, an amount of the urethane adhesive U remaining inside the sub tank 3 is reduced gradually, and, as shown in FIG. 5, the sub follower plate 5 is lowered inside the sub tank 3. However, as described earlier, since the capacity of the sub tank 3 is set to a value larger than an amount of the urethane adhesive U required during the replacement operation of the main tank 2 (a required amount of a fluid that is fed under pressure to the fluid passage) by a given amount, the replacement operation of the main tank 2 is completed before the remaining urethane adhesive U inside the sub tank 3 is gone. Therefore, after completion of the replacement operation of the main tank 2, the urethane adhesive U is forced out from the main tank 2 and flows into the sub tank 3, and the urethane adhesive U is thus supplied in the sub tank 3. Therefore, it becomes possible to continuously feed the urethane adhesive U under pressure toward the fluid passage. As described above, according to the embodiment, during the replacement operation of the main tank 2, it is possible to feed the urethane adhesive U inside the sub tank 3 to the fluid passage under pressure. Also, since it is not necessary to provide a plurality of pump units having the same configuration side by side, it is possible to reduce the size of the fluid pressure-feed device 1.

Further, in the embodiment, during the replacement operation of the main tank 2, the sub follower plate 5 applies pressurizing force to the urethane adhesive U inside the sub tank 3. Due to the pressurizing force, the urethane adhesive U is able to flow toward the drum pump 8 from the sub tank 3 in a favorable manner, and it is thus possible to carry out the pressure-feed operation of the urethane adhesive U by the drum pump 8 in a favorable manner. Thus, an amount of the urethane adhesive U to be fed under pressure to the fluid passage is optimized.

Further, in the embodiment, only when pressure of the urethane adhesive U inside the main tank 2 becomes a given value or higher, the check plate 45 moves upward and the urethane adhesive U is allowed to flow from the main tank 2 to the sub tank 3. Thus, a backflow of the urethane adhesive U from the sub tank 3 to the main tank 2 does not happen. Therefore, it is possible to prevent a situation where no urethane adhesive U remains inside the sub tank 3 at a point when the main tank 2 needs to be replaced. As a result, it is possible to avoid a situation where there is an insufficient amount of the urethane adhesive U remaining inside the sub tank 3 during the replacement operation of the main tank 2, and the urethane adhesive U can be continuously fed under pressure toward the fluid passage.

Other Embodiments

The disclosure is not limited to the foregoing embodiment, and all changes and applications can be made without departing from the scope of claims and its equivalence.

For example, in the embodiment, a case is described in which the disclosure is applied to the fluid pressure-feed device 1 in a vehicle body manufacturing line. The fluid pressure-feed device 1 feeds the urethane adhesive U under pressure toward the coating robot. The urethane adhesive U is to be applied to the window glass. However, the disclosure is not limited to this, and may be applied to a fluid pressure-feed device that feeds a fluid other than the urethane adhesive U under pressure toward a fluid passage.

Also, in the foregoing embodiment, the sub tank 3 is connected with the upper portion of the main follower plate 4, and the check valve (a valve mechanism made of the check plate 45 and the coil spring 46) is provided in the main follower plate 4. The disclosure is not limited to this, and the main follower plate 4 and the sub tank 3 may be connected with each other by a pipe, and a check valve may be provided in the pipe. However, in this case, the sub tank 3 also moves integrally with upward and downward movements of the main follower plate 4 (integrally moves upward and downward).

The disclosure is applicable to a fluid pressure-feed device in a vehicle body manufacturing line, the fluid pressure-feed device feeding an urethane adhesive under pressure to a coating robot, and the urethane adhesive being applied to a window glass.

What is claimed is:

1. A fluid pressure-feed device that feeds a fluid under pressure to a fluid passage, the device comprising:

a main tank configured to be filled with the fluid;

a main follower plate that applies a first pressurizing force to the fluid inside the main tank;

a sub tank into which the fluid forced out from the main tank flows, the sub tank being provided integrally with the main follower plate;

a pump that feeds the fluid inside the sub tank under pressure toward the fluid passage;

a sub follower plate configured to apply a second pressurizing force to the fluid inside the sub tank to force the fluid toward the pump during a replacement operation of the main tank;

a check valve disposed in the main follower plate comprising:

a check plate, and a spring disposed between and contacting a joint plate attached to a lower surface of the sub tank and the check plate, the spring being configured to apply a biasing force to the check plate;

a body disposed above the pump;

at least one first cylinder comprising a piston rod, the at least one first cylinder having a lower end connected to a top end of the pump and further having an upper end connected to the body, the at least one first cylinder configured to, when actuated, vertically move the sub follower plate and the pump with respect to the sub tank, wherein the check valve is configured to open when a pressure of the fluid inside the main tank becomes a given value or higher.

2. The fluid pressure-feed device according to claim 1, wherein a capacity of the sub tank is set so as to be smaller than a capacity of the main tank and also larger than a required amount of the fluid by a given value, the required amount of the fluid being an amount of the fluid to be fed under pressure toward the fluid passage during the replacement operation of the main tank.

3. The fluid pressure-feed device according to claim 1, wherein the joint plate comprises an opening in the center of the joint plate to allow fluid to pass from the main tank to the sub tank.

4. The fluid pressure-feed device according to claim 1, further comprising:

at least one second cylinder comprising a piston rod, the at least one second cylinder having an upper end connected to the body and configured to, when actuated, vertically move the main follower plate, the sub tank, the sub follower plate, and the pump by vertically moving the body.

5. The fluid pressure-feed device according to claim 4, further comprising:

at least one tie rod having a lower end connected to the main follower plate, and further having an upper end connected to the body, wherein the at least one second cylinder is configured to move the main follower plate by vertically moving the at least one tie rod by vertically moving the body.

6. The fluid pressure-feed device according to claim 1, wherein the main follower plate comprises a heater.

* * * * *